United States Patent [19]

Lamberti

[11] Patent Number: 4,488,989

[45] Date of Patent: Dec. 18, 1984

[54] AQUEOUS COMPOSITIONS CONTAINING UREA AS A HYDROTROPE

[75] Inventor: Vincent Lamberti, Upper Saddle River, N.J.

[73] Assignee: Lever Brothers Company, New York, N.Y.

[21] Appl. No.: 551,230

[22] Filed: Nov. 14, 1983

[51] Int. Cl.[3] ..... C11D 7/52

[52] U.S. Cl. ..... 252/541; 252/118; 252/153; 252/162; 252/170; 252/173; 252/DIG. 14

[58] Field of Search ..... 252/111, 117, 118, 153, 252/148, 541, 545, DIG. 5, DIG. 13, DIG. 14, 170, 162

[56] References Cited

U.S. PATENT DOCUMENTS

| | | | |
|---|---|---|---|
| 1,035,756 | 8/1912 | Stanek | |
| 2,251,768 | 8/1941 | Swain | |
| 2,346,425 | 4/1944 | Kirkpatrick | |
| 2,947,702 | 8/1960 | Coskie | 252/DIG. 14 |
| 3,175,977 | 3/1965 | Smithson | |
| 3,943,234 | 3/1976 | Roggenkamp | |
| 3,954,648 | 5/1976 | Belcak et al. | 252/171 |
| 3,963,635 | 6/1976 | Dawson et al. | |
| 3,975,515 | 8/1976 | Wajaroff | |
| 4,079,020 | 3/1978 | Mills et al. | 252/DIG. 14 |
| 4,092,272 | 5/1978 | Nishimura et al. | 252/DIG. 14 |
| 4,143,159 | 3/1979 | Moller et al. | 424/358 |
| 4,195,077 | 3/1980 | Marsh et al. | 252/DIG. 13 |
| 4,235,758 | 11/1980 | Dawson et al. | 252/541 |

FOREIGN PATENT DOCUMENTS

| | | |
|---|---|---|
| 1475968 | 1/1970 | France . |
| 1314616 | 3/1973 | United Kingdom |

OTHER PUBLICATIONS

Chemical Abstracts, No. 28:8714b.
Chemical Abstracts, vol. 51(1957) pp. 11724–11725.
Chemical Abstracts, vol. 54, No. 54:25477f.
Chemical Abstracts, No. 62:6350c.
Chemical Abstracts, vol. 74 (1971) No. 15719t.
Chemical Abstracts, vol. 79 (1973) No. 147629b.
Chemical Abstracts, vol. 82 (1975) No. 88052v.
Chemical Abstracts, vol. 84 No. 84:152615b.
Chemical Abstracts, vol. 92 (1980) No. 92:116257t.

*Primary Examiner*—Paul Lieberman
*Assistant Examiner*—Hoa Van Le
*Attorney, Agent, or Firm*—James J. Farrell

[57] ABSTRACT

An aqueous composition, particularly a liquid detergent composition comprising urea as a hydrotrope, of improved storage stability which further comprises certain esters, e.g., methyl and ethyl lactates which hydrolyze at a rate comparable to that of the hydrolysis of urea to ultimately form ammonium salts whereby said detergent composition is maintained at a stable overall pH level. In an alternative, competing, but nonetheless beneficial mode of operation the ammonia generated by the hydrolysis of urea may react directly with the esters of the invention by ammonolysis. The acid from which said ester is derived has a $pK_a$ in the range of about 2 to about 4.

15 Claims, No Drawings

AQUEOUS COMPOSITIONS CONTAINING UREA AS A HYDROTROPE

This invention relates to aqueous compositions, particularly liquid detergents of improved storage stability which comprise urea as a hydrotrope in combination with a hydrolyzable ester as the storage stability promoting component. A co-hydrotrope such as lower alkanols containing from one to three carbon atoms may or may not be present.

A typical light duty liquid detergent composition generally comprises a hydrotrope amongst its various other ingredients. Many other aqueous compositions, e.g. skin creams, lotions, sprays, shampoos, etc., need comparable hydrotropes. A hydrotrope is a substance or a mixture of substances which increases the solubility in water of another material, which may be either insoluble or only partially soluble therein. The most common materials used in this regard are urea, lower molecular weight alkanols, glycols and ammonium, potassium or sodium salts of toluene, xylene or cumene sulfonates.

Some hydrotopes, and in particular ammonium xylene sulfonate which find common use in liquid detergent compositions tend to be somewhat expensive. It has been found that urea can function as a cost effective substitute for ammonium xylene sulfonate as a hydrotrope, even though greater quantities of urea vis a vis ammonium xylene sulfonate are usually needed to achieve the same results. Optimally, a mixture of urea with a short chain alkanol such as ethanol may be used as a hydrotrope in place of ammonium xylene sulfonate. Likewise, urea with ethanol may be used as a hydrotropic mixture in aqueous compositions such as those for human use, namely, skin creams, lotions, sprays, shampoos, etc.

The employment of urea and ethanol mixtures as aforesaid in liquid detergent compositions while otherwise advantageous as described is undesirable in that urea slowly hydrolyzes to free ammonia leading both to unacceptable odors and to an increase in the pH of the liquid detergent composition to an unacceptably high level. In a typical light duty liquid detergent composition for household use, such as that which is customarily used for dishwashing purposes, an acceptable pH is slightly acidic and falls within the range of about 4.5 to about 7.0 although alkaline pH ranges are also known.

The invention provides a means for combating the aforementioned unacceptable ammoniacal odors and increases in the pH of the aqueous compositions, paticularly liquid detergents by providing a Lowry-Bronsted acid releasing system wherein the generation of free ammonia and of such acid occur at more or less equal rates. Thereby, all ammonia generated from the decomposition of the urea hydrotrope is neutralized more or less as soon as it is liberated. In an alternative, competing, but nonetheless beneficial mode of operation the ammonia generated by the hydrolysis of urea may react directly with the esters of the invention by a process known as ammonolysis. As a consequence thereof, the use of urea as a hydrotrope in a liquid detergent composition is made feasible regardless of the tendency of urea to decompose to free ammonia.

According to the invention, an aqueous composition, particularly a liquid detergent composition comprising urea as a hydrotrope system typically including up to 15% w/w urea and up to 10% w/w ethanol is improved in its storage stability by the incorporation therein of an effective amount of a hydrolyzable ester which hydrolyzes at a sufficient rate and in sufficient amount to liberate a Lowry-Bronsted acid to neutralize the ammonia being liberated by the slow hydrolysis of the urea in the detergent composition. The Lowry-Bronsted acid can be characterized as having an acidity constant pKa in the range of about 2 to about 4 as measured at room temperature. Such esters include those which would be derived from the reaction products of alkanols selected from the group consisting of methanol, ethanol, 1-propanol, 2-propanol and mixtures thereof with acids selected from the group consisting of lactic acid, glycolic acid, malonic acid, maleic acid, aspartic acid, glutamic acid, glycine and mixtures thereof. Of course, esterification of the corresponding alkanols and acids is not the only available method of synthesizing the esters which are gainfully employed in the practice of the invention.

Urea is used as a component of many liquid or quasi-liquid compositions, whether as a hydrotrope or for its own beneficial properties.

Thus, urea forms a component of aqueous compositions including liquid detergent compositions, shampoos, hair and skin lotions and creams to name just a few representative examples.

In all such liquid or quasi-liquid emulsions, which contain both urea and water, there is inevitable and unavoidable hydrolysis of the urea to free ammonia. The liberation of such free ammonia raises the pH of the liquid or emulsion composition to an unacceptably high level, not to mention the generation of undesirable odors which detract from the consumer appeal of such liquid or quasi-liquid compositions. In the case of emulsions, increased alkalinity of the aqueous phase owing to the hydrolysis of urea may cause the emulsion to lose its character as an emulsion by interfering with the electrostatic forces separating the globules of the dispersed phase from each other.

In accordance with this invention, a method is provided for counteracting the adverse affects of the hydrolysis of urea in any composition where urea and water are together present in such a composition.

According to this invention, the hydrolysis of urea is counteracted by the simultaneous hydrolysis of a hydrolyzable carboxylic ester incorporated within the same liquid or quasi-liquid composition. Thereby the free carboxylic acid generated from the hydrolysis of such an ester neutralizes the free ammonia generated by the concurrent hydrolysis of urea as soon as such free ammonia is generated. The free alkanol and the ammonium salt generated in the process of such ester hydrolysis generally have no detrimental effect upon the properties of the liquid or quasiliquid composition in question.

In an alternative, competing, but nonetheless beneficial mode of operation the ammonia generated by the hydrolysis of urea may react directly with the esters of the invention by a process known as ammonolysis. Thus, one molecule of ammonia reacts with one molecule of an ester in ammonolysis to yield a molecule of an amide corresponding to the acidic portion of the ester molecule whereby the carbonyl group of the ester becomes the carbonyl group of the amide. The alcohol portion of the ester molecule is liberated as a free alcohol. Once again the free alcohol and the amide have no effect upon the pH or overall beneficial properties of the liquid or quasi-liquid composition.

In accordance with the above considerations, six aqueous compositions each comprising 6 (six) weight percent urea and 2 (two) weight percent ethanol were prepared. The first composition served as a control wherein no further stabilizing component was incorporated. The second, third and fourth compositions further included one weight percent of sulfamic acid, a basic salt and a surface active agent, respectively. The foregoing are materials which have been used in liquid detergent compositions. The fifth and sixth compositions included one weight percent each of selected esters. The pH of each one of such six compositions was adjusted to the value of 6.7 with ammonium hydroxide, and thereafter, each one of such six compositions was separated into two batches or two sets of compositions, each set again consisting of six different compositions. The first set was stored at room temperature for two weeks and the pH of the respective compositions at the end of such two week period was determined. The second set was stored for two weeks at the elevated temperature of 125° F., to simulate a longer period of storage, and the resulting pH of each one of the six compositions concerned was likewise determined at the end of such two week period. The pH measurement in all cases was taken at room temperature.

The results of the foregoing studies are summarized in Table 1 below.

TABLE 1

| Composition No. | | Initial pH (adjusted with $NH_4OH$) | pH after 2 weeks at: 125° F | Room Temperature |
|---|---|---|---|---|
| 1 | 6% urea + 2% ethanol (control) | 6.7 | 8.8 | 7.3 |
| 2 | 6% urea + 2% ethanol + 1% Sulfamic acid | 6.7 | 8.1 | 7.0 |
| 3 | 6% urea + 2% ethanol + 1% Na Phosphate Dibasic | 6.7 | 6.7 | 7.3 |
| 4 | 6% urea + 2% ethanol + 1% $C_{10}$ secondary Sulfate | 6.7 | 8.8 | 7.5 |
| 5 | 6% urea + 2% ethanol + 1% Methyl Lactate | 6.7 | 5.8 | 6.4 |
| 6 | 6% urea + 2% ethanol + 1% Ethyl lactate | 6.7 | 6.0 | 6.7 |

It is at once evident from the data contained in Table 1 above, that there was a significant increase in the alkalinity of Composition Nos. 1 through 4, over the period of time involved, at either or both of the temperature conditions studied.

On the other hand, it will be seen that Composition Nos. 5 and 6, which contained the esters of the present invention not only maintained the initial pH level for the most part (particularly in the case of Composition No. 6 as it was stored at room temperature) but that in all cases, the pH level in fact fell somewhat below the initial pH level of 6.7, well within the desired pH range for light duty liquid detergent compositions.

It will therefore be seen from the above data that the esters of the present invention may be successfully used to counteract any increase in alkalinity caused in an aqueous liquid or quasi-liquid composition containing urea as a result of the hydrolysis of such urea component.

The application of the above findings with particular reference to light duty liquid detergent compositions was thereafter tested out. Accordingly, light duty liquid detergent compositions corresponding to the formulations shown below and labelled Detergent Composition A and Control Detergent Composition B were prepared.

DETERGENT COMPOSITION A AND CONTROL DETERGENT COMPOSITION B

| Ingredients (as percentages w/w) | COMPOSITION A | COMPOSITION B |
|---|---|---|
| 1. Detergent active compound: | | |
| (a) Ammonium linear $C_{10}$-$C_{15}$ alkyl benzene sulphonate | 24.1 | 24.1 |
| (b) Lauric diethanolamide | 3.0 | 3.0 |
| (c) Ammonium $C_{10}$-$C_{15}$ alcohol-3 moles ethylene oxide ether sulfate | 4.71 | 4.71 |
| 2. Hydrotrope: | | |
| (a) Urea | 6 | — |
| (b) Ethanol | 2 | — |
| (c) Ammonium xylene sulfonate | — | 8.0 |
| 3. Water* to | 95 | 95 |

*leaves 5% hole for introduction of the esters of the invention (except in the case of control Composition B), then to 100% with further water Samples of the light duty liquid compositions thus prepared were stored at two different temperatures, i.e., room temperature and 125° F. The pH of these samples was measured periodically over a time interval of about sixteen (16) weeks. The results are shown in Table 2. The control batches 19 through 21 of Table 2 did not contain the esters of the present invention. Control batch 22 of Table 2 was simply Control Detergent Composition B which contained no urea/ethanol mixture but instead contained 8% w/w of ammonium xylene sulfonate as already noted above. The other batches contained two of the esters of the present invention (in the alternative) with or without suitable buffers. As Table 2 indicates, in all cases, all the respective batches were divided into two portions, and one portion was stored at room temperature, while the other portion was stored at the elevated temperature of 125° F. to simulate the decomposition occurring over a longer period of time at room temperature.

TABLE 2

STORAGE STABILITY OF DETERGENT COMPOSITION A (BATCHES 1 THROUGH 21) AND OF DETERGENT COMPOSITION B (BATCH 22)

| Batch No | Additional Ingredients wt. % w/w | Initial pH | Storage Conditions | pH After Storage 1 week | 2 weeks | 3 weeks | 4 weeks | 6 weeks | 8 weeks | 14 weeks | 16 weeks |
|---|---|---|---|---|---|---|---|---|---|---|---|
| 1 | 0.1 Methyl Lactate + 0.5% | 6.7 | room temperature | 6.7 | 6.7 | 6.8 | 6.7 | 6.8 | 6.8 | — | — |
| | Sodium Phosphate dibasic | | 125° F. | 6.8 | 7.1 | 7.3 | 7.4 | 7.8 | 8.2 | — | — |
| 2 | 0.25 Methyl Lactate + 0.5% | 6.7 | room temperature | 6.6 | 6.6 | 6.6 | 6.7 | 6.6 | 6.6 | — | — |
| | Sodium Phosphate dibasic | | 125° F. | 6.6 | 6.8 | 6.9 | 7.2 | 7.7 | 8.0 | — | — |
| 3 | 1.0 Methyl Lactate + 0.5% | 6.7 | room temperature | 6.5 | 6.4 | 6.3 | 6.2 | 6.2 | 6.0 | 6.0 | — |
| | Sodium Phosphate dibasic | | 125° F. | 6.2 | 6.4 | 6.3 | 6.5 | 7.0 | 7.2 | 7.8 | — |
| 4 | 0.1 Ethyl Lactate + 0.5% | 6.7 | room temperature | 6.6 | 6.8 | 6.8 | 6.7 | 6.8 | 6.8 | — | — |
| | Sodium Phosphate dibasic | | 125° F. | 6.8 | 7.3 | 7.4 | 7.6 | 7.9 | 8.2 | — | — |
| 5 | 0.25 Ethyl Lactate + 0.5% | 6.7 | room temperature | 6.7 | 6.7 | 6.7 | 6.7 | 6.7 | 6.8 | — | — |
| | Sodium Phosphate dibasic | | 125° F. | 6.8 | 7.1 | 7.0 | 7.3 | 7.5 | 8.0 | — | — |
| 6 | 1.0 Ethyl Lactate + 0.5% | 6.7 | room temperature | 6.7 | 6.7 | 6.6 | 6.5 | 6.5 | 6.5 | 6.3 | — |
| | Sodium Phosphate dibasic | | 125° F. | 6.7 | 6.8 | 6.9 | 5.8 | 7.1 | 7.1 | 7.3 | — |
| 7 | 0.1 Methyl Lactate + 0.5% | 6.7 | room temperature | 6.8 | 6.9 | 6.7 | 6.9 | 7.0 | 7.1 | — | — |
| | Sodium Citrate | | 125° F. | 7.8 | 8.0 | 8.1 | 8.3 | 8.4 | 8.6 | — | — |
| 8 | 0.25 Methyl Lactate + 0.5% | 6.8 | room temperature | 6.7 | 6.8 | 6.6 | 6.7 | 6.8 | 6.7 | — | — |
| | Sodium Citrate | | 125° F. | 7.4 | 7.7 | 7.8 | 8.1 | 8.2 | 8.4 | — | — |
| 9 | 1.0 Methyl Lactate + 0.5% | 6.8 | room temperature | 6.7 | 6.6 | 6.3 | 6.4 | 6.4 | 6.4 | 6.4 | — |
| | Sodium Citrate | | 125° F. | 6.7 | 6.8 | 6.8 | 6.8 | 7.1 | 7.5 | 7.9 | — |
| 10 | 0.1 Ethyl Lactate + 0.5% | 6.7 | room temperature | 6.8 | 6.8 | 6.7 | 6.9 | 7.0 | 7.1 | — | — |
| | Sodium Citrate | | 125° F. | 7.8 | 8.0 | 8.1 | 8.3 | 8.3 | 8.6 | — | — |
| 11 | 0.25 Ethyl Lactate + 0.5% | 6.8 | room temperature | 6.7 | 6.7 | 6.6 | 6.8 | 6.9 | 7.0 | — | — |
| | Sodium Citrate | | 125° F. | 7.8 | 7.9 | 7.9 | 8.1 | 8.2 | 8.4 | — | — |
| 12 | 1.0 Ethyl Lactate + 0.5% | 6.8 | room temperature | 6.8 | 6.7 | 6.6 | 6.7 | 6.7 | 6.8 | 6.6 | — |
| | Sodium Citrate | | 125° F. | 7.2 | 7.2 | 7.2 | 7.3 | 7.4 | 7.6 | 7.5 | — |
| 13 | 0.1 Methyl Lactate | 6.6 | room temperature | 6.6 | 6.5 | 6.4 | 6.5 | 6.6 | 6.7 | — | — |
| | | | 125° F. | 7.2 | 7.4 | 7.6 | 7.9 | 8.2 | 8.4 | — | — |
| 14 | 0.25 Methyl Lactate | 6.5 | room temperature | 6.4 | 6.4 | 6.3 | 6.4 | 6.4 | 6.4 | — | — |
| | | | 125° F. | 7.0 | 7.0 | 7.0 | 7.2 | 7.8 | 8.1 | — | — |
| 15 | 1.0 Methyl Lactate | 6.8 | room temperature | 6.4 | 6.1 | 5.9 | 5.9 | 5.9 | 6.1 | 6.0 | 6.0 |
| | | | 125° F. | 6.4 | 6.4 | 6.4 | 6.5 | 6.7 | 6.9 | 7.6 | 7.7 |
| 16 | 0.1 Ethyl Lactate | 6.7 | room temperature | 6.6 | 6.6 | 6.7 | 6.6 | 6.8 | 6.9 | — | — |
| | | | 125° F. | 7.4 | 7.7 | 7.8 | 8.0 | 8.2 | 8.3 | — | — |
| 17 | 0.25 Ethyl Lactate | 6.8 | room temperature | 6.8 | 6.7 | 6.7 | 6.8 | 6.8 | 6.8 | — | — |
| | | | 125° F. | 7.3 | 7.4 | 7.5 | 7.6 | 7.9 | 8.0 | — | — |
| 18 | 1.0 Ethyl Lactate | 6.7 | room temperature | 6.6 | 6.5 | 6.3 | 6.3 | 6.4 | 6.5 | 6.6 | 6.5 |
| | | | 125° F. | 6.8 | 6.8 | 6.8 | 6.9 | 7.0 | 7.2 | 7.1 | 7.4 |
| 19 | 0.5 Sodium Phosphate dibasic | 6.7 | room temperature | 6.6 | 6.6 | 6.6 | 6.6 | 6.7 | 6.7 | — | — |
| | | | 125° F. | 7.1 | 7.3 | 7.4 | 7.7 | 8.2 | 8.3 | — | — |
| 20 | 0.5 Sodium Citrate | 6.8 | room temperature | 6.7 | 6.8 | 6.9 | 6.9 | 7.1 | 7.4 | — | — |
| | | | 125° F. | 8.0 | 8.2 | 8.4 | 8.5 | 8.6 | 8.7 | — | — |
| 21 | None (Control) | 6.6 | room temperature | 6.7 | 6.6 | 6.7 | 6.7 | 6.8 | 7.1 | — | — |
| | | | 125° F. | 7.6 | 7.9 | 8.1 | 8.2 | 8.4 | 8.5 | — | — |
| 22 | None (Control Detergent | 6.7 | room temperature | 7.1 | 7.1 | 7.0 | 7.0 | 7.2 | 7.4 | 7.3 | — |
| | Composition B) | | 125° F. | 7.5 | 7.7 | 7.8 | 7.9 | 8.0 | 8.0 | 7.7 | — |

Table 2 shows that best results were obtained from unbuffered compositions containing a hydrolyzable ester of the present invention, namely, methyl or ethyl lactate.

It will also be observed that control detergent composition B which incorporated 8% w/w of the customary hydrotrope ammonium xylene sulfonate was also subject to a rise in pH during storage, although this was obviously not caused by the hydrolysis of urea but is believed to be due to the slow hydrolysis of lauric diethanolamide. In any event, the increase of pH in the case of control detergent composition B (Batch No. 22 of Table 2) was less than that in the case of (control) detergent composition A (Batch No. 21 of Table 2) containing 6% w/w urea with 2% w/w ethanol as a substitute for 8% w/w ammonium xylene sulfonate at the elevated 125° F. temperature.

It is therefore evident that although the replacement of ammonium xylene sulfonate by a corresponding quantity of a urea and ethanol mixture, is effective as a substitute hydrotrope, it is nonetheless disadvantageous in that the compositions containing the urea with ethanol mixture are subject to objectionable increases in alkalinity. At the same time, it is also evident that such disadvantage is effectively overcome by the use of the hydrolyzable esters of the present invention.

The following further studies demonstrate the general applicability in the practice of the present invention of esters other than methyl and ethyl lactate. Accordingly, several different esters were incorporated into detergent composition C (listed below) which contained 6 wt.% urea and 4 wt.% ethanol as the hydrotropic system. The control composition D contained ammonium xylene sulfonate instead of a urea and ethanol mixture.

DETERGENT COMPOSITION C AND CONTROL DETERGENT COMPOSITION D

| Ingredients (as percentages w/w) | COMPOSITION C | COMPOSITION D |
|---|---|---|
| 1. Detergent active compound: | | |
| (a) Ammonium linear $C_{10}$-$C_{15}$ alkyl benzene sulphonate | 30.0 | 30.0 |
| (c) Ammonium $C_{10}$-$C_{15}$ alcohol-3 moles ethylene oxide ether sulfate | 5.0 | 5.0 |
| 2. Hydrotrope: | | |
| (a) Urea | 6 | — |
| (b) Ethanol | 4 | — |
| (c) Ammonium xylene sulfonate | — | 9 |
| 3. Water* | to 95 | 95 |

*leaves 5% hole for introduction of the esters of the invention (except in the case of control Composition D), then to 100% with further water The respective hydrolyzable esters in question were incorporated into the urea and ethanol modified liquid detergent compositions A and C, respectively, and the formulations were stored at room temperature and at 125° F. The resulting pH values as measured at room temperature are shown in Tables 3 and 4 below. Table 3 shows the results obtained with Composition A and its corresponding control composition (Composition B). Table 4 shows the results obtained with Composition C and its corresponding control composition (Composition D).

TABLE 3

STORAGE STABILITY OF DETERGENT COMPOSITIONS A AND B WITH SELECTED HYDROLYZABLE ESTERS

| Batch No. | Additional Ingredients wt. % w/w | Molecular Weight | Initial pH | Storage Conditions | pH After Storage 1 week | 2 weeks | 3 weeks | 4 weeks | 6 weeks | 8 weeks | 10 weeks | 12 weeks |
|---|---|---|---|---|---|---|---|---|---|---|---|---|
| 1 | 1.0 Methyl Lactate | 104.11 | 6.8 | room temperature | 6.5 | 6.6 | 6.2 | 6.2 | 6.2 | 6.0 | 6.0 | 6.0 |
| | | | | 125° F. | 6.2 | 6.7 | 6.5 | 6.6 | 6.9 | 6.8 | 7.0 | 7.2 |
| 2 | 1.125 Ethyl Lactate | 118.13 | 6.7 | room temperature | 6.2 | 6.7 | 6.4 | 6.5 | 6.5 | 6.4 | 6.3 | 6.3 |
| | | | | 125° F. | 6.3 | 7.0 | 6.9 | 6.8 | 7.0 | 7.0 | 7.1 | 7.1 |
| 3 | 1.27 n-propyl Lactate | 132.16 | 6.6 | room temperature | 6.1 | 6.7 | 6.6 | 6.6 | 6.6 | 6.6 | 6.5 | 6.5 |
| | | | | 125° F. | 6.5 | 7.1 | 7.1 | 7.0 | 7.2 | 6.9 | 7.2 | 7.1 |
| 4 | 1.4 n-butyl Lactate | 146.19 | 6.7 | room temperature | 6.6 | 7.2 | 7.1 | 7.0 | — | — | 6.7 | 6.7 |
| | | | | 125° F. | 6.7 | 7.3 | 7.4 | 7.4 | — | — | 7.5 | 7.5 |
| 5 | 0.71 Methyl Acetate | 74.08 | 6.8 | room temperature | 6.3 | 6.9 | 6.9 | 6.9 | — | — | — | — |
| | | | | 125° F. | 6.7 | 7.5 | 7.4 | 7.5 | — | — | — | — |
| 6 | 0.85 Ethyl Acetate | 88.11 | 6.8 | room temperature | 6.3 | 7.0 | 7.0 | 7.0 | — | — | — | — |
| | | | | 125° F. | 6.8 | 7.8 | 7.9 | 7.9 | — | — | — | — |
| 7 | Control Batch (no additives) | — | 6.6 | room temperature | 6.4 | 7.2 | 7.0 | 7.1 | — | — | — | — |
| | | | | 125° F. | 6.8 | 7.9 | 8.2 | 8.2 | — | — | — | — |
| 8 | Control Batch Composition B | — | 6.7 | room temperature | 6.5 | 7.2 | 7.1 | 7.1 | 6.9 | 6.7 | — | — |
| | | | | 125° F. | 6.5 | 7.3 | 7.3 | 7.3 | 7.5 | 7.3 | — | — |
| 9 | Control Batch Composition B | — | 6.8 | room temperature | 6.9 | 7.1 | 6.8 | 6.7 | 6.9 | 6.9 | 6.9 | — |
| | | | | 125° F. | 7.1 | 7.2 | 7.1 | 7.3 | 7.5 | 7.5 | 7.5 | — |
| 10 | Control Batch Composition B | — | 6.5 | room temperature | 6.7 | 7.1 | 6.7 | 6.7 | 6.7 | 6.9 | 6.7 | 6.5 |
| | | | | 125° F. | 6.8 | 7.4 | 7.2 | 7.1 | 7.2 | 7.5 | 7.4 | 7.3 |
| 11 | 1.21 Glycine Methyl Ester (Hydrochloride) | 125.6 | 6.5 | room temperature | 5.4 | 5.2 | 4.8 | 4.8 | 4.7 | 4.9 | 4.8 | 4.7 |
| | | | | 125° F. | 5.2 | 5.8 | 6.0 | 6.1 | 6.4 | 6.9 | 7.0 | 7.1 |
| 12 | 1.55 L-Glutamic Acid mono-Methyl Ester | 161.2 | 6.6 | room temperature | 6.5 | 6.4 | 6.0 | 5.9 | 5.8 | 6.0 | 5.8 | — |
| | | | | 125° F. | 6.1 | 6.5 | 6.5 | 6.7 | 7.0 | 7.3 | 7.5 | — |
| 13 | 1.90 DL-Aspartic Acid Dimethyl Ester (Hydrochloride) | 197.6 | 6.5 | room temperature | 5.5 | 4.9 | 4.7 | 4.5 | 4.4 | 4.5 | 4.5 | — |
| | | | | 125° F. | 4.9 | 5.5 | 5.7 | 6.1 | 6.6 | 7.0 | 7.0 | — |
| 14 | 1.38 Dimethyl Maleate | 144.12 | 6.7 | room temperature | 6.5 | 6.2 | 6.6 | 6.2 | 6.1 | 6.2 | 6.1 | — |
| | | | | 125° F. | 6.6 | 6.3 | 6.7 | 6.5 | 6.5 | 6.8 | — | 6.9 |
| 15 | 1.54 Diethyl Malonate | 160 | 6.7 | room temperature | 6.7 | 6.3 | 6.6 | 6.4 | 6.3 | 6.3 | 6.4 | — |
| | | | | 125° F. | 6.9 | 6.8 | 6.9 | 6.7 | 6.6 | 6.7 | — | 6.7 |
| 16 | 1.27 *Dimethyl Malonate | 132.12 | 6.7 | room temperature | 6.2 | 5.9 | 6.1 | 5.9 | 5.7 | 5.8 | 5.8 | — |
| | | | | 125° F. | 6.2 | 6.1 | 6.2 | 6.2 | 6.1 | 6.3 | — | 6.5 |
| 17 | 0.86 Methyl Glycolate | 90.08 | 6.8 | room temperature | 5.8 | 5.4 | 5.5 | 5.5 | 5.3 | 5.4 | 5.6 | — |
| | | | | 125° F. | 6.3 | 6.2 | 6.4 | 6.5 | 6.6 | 7.0 | — | 7.5 |
| 18 | 1.46 Methyl Salicylate | 152 | 6.7 | room temperature | 6.6 | 6.6 | 6.7 | 6.8 | 7.6 | — | — | — |
| | | | | 125° F. | 7.3 | 7.7 | 7.9 | 8.0 | 8.0 | — | — | — |
| 19 | 1.40 Dimethyl Succinate | 146 | 6.7 | room temperature | 6.5 | 6.4 | 6.7 | 6.8 | 6.6 | 6.5 | 6.7 | — |
| | | | | 125° F. | 6.9 | 7.0 | 7.1 | 7.1 | 7.1 | 7.2 | — | 7.3 |
| 20 | Control Batch Composition B | — | 6.7 | room temperature | 6.5 | 6.5 | 6.7 | 6.7 | 6.6 | 6.7 | 6.8 | — |
| | | | | 125° F. | 6.6 | 6.9 | 7.2 | 7.1 | 7.3 | 7.3 | — | 7.5 |
| 21 | 1.34 **Glycine Ethyl Ester (Hydrochloride) | 139.4 | 6.7 | room temperature | 6.1 | 5.9 | 5.5 | 5.7 | 5.4 | 5.5 | — | — |
| | | | | 125° F. | 5.8 | 6.1 | 6.3 | 6.0 | 6.8 | 7.0 | — | — |
| 22 | 1.45 Glycine Propyl Ester | 151.4 | 6.7 | room temperature | 6.4 | 6.2 | 5.8 | 5.2 | 5.8 | 5.9 | — | — |
| | | | | 125° F. | 6.0 | 6.3 | 6.5 | 6.1 | 7.0 | 7.2 | — | — |
| 23 | ***Control Batch Composition B | — | 6.7 | room temperature | 6.6 | 6.8 | 6.7 | 6.9 | 6.8 | — | — | — |
| | | | | 125° F. | 6.9 | 7.2 | 7.1 | 7.4 | 7.4 | — | — | — |

*Cloudy at 125° F. in 12 weeks
**Cloudy at Room Temperature in 4 weeks

TABLE 4

STORAGE STABILITY OF DETERGENT COMPOSITIONS C AND D WITH SELECTED HYDROLYZABLE ESTERS

| Batch No. | Additional Ingredients wt. % w/w | Molecular Weight | Initial pH | Storage Conditions | pH After Storage: 1 week | 2 weeks | 3 weeks | 4 weeks | 6 weeks | 8 weeks | 10 weeks | 12 weeks |
|---|---|---|---|---|---|---|---|---|---|---|---|---|
| 1 | 1.0 Methyl Lactate | 104.11 | 6.5 | room temperature | 6.6 | 6.5 | 6.4 | 6.3 | 6.3 | 6.5 | - | |
| | | | | 125° F. | 6.5 | 6.7 | 6.6 | 6.6 | 6.7 | 7.3 | | |
| 2 | 1.135 Ethyl Lactate | 118.13 | 6.5 | room temperature | 6.7 | 6.7 | 6.6 | 6.6 | 6.6 | 6.7 | | |
| | | | | 125° F. | 6.8 | 6.9 | 7.0 | 7.0 | 7.0 | 7.3 | | |
| 3 | 1.27 n-propyl Lactate | 132.16 | 6.6 | room temperature | 6.6 | 6.8 | 6.7 | 6.6 | 6.7 | 6.9 | - | |
| | | | | 125° F. | 7.0 | 7.1 | 7.1 | 7.0 | 7.1 | 7.3 | - | |
| 4 | 1.21 *Glycine Methyl Ester (Hydrochloride) | 125.6 | 6.6 | room temperature | 6.0 | 5.8 | 5.5 | 5.3 | 5.3 | 5.4 | - | |
| | | | | 125° F. | 5.3 | 6.1 | 6.5 | 6.5 | 6.9 | 7.3 | | |
| 5 | 1.55 L-Glutamic Acid mono-Methyl Ester | 161.2 | 6.6 | room temperature | 6.3 | 6.4 | 6.2 | 6.2 | 6.2 | 6.2 | | |
| | | | | 125° F. | 6.0 | 6.6 | 6.4 | 6.9 | 7.2 | 7.5 | | |
| 6 | 1.90 **DL-Aspartic Acid Dimethyl Ester (Hydrochloride) | 197.6 | 6.6 | room temperature | 5.7 | 5.7 | 5.4 | 5.2 | 5.1 | 5.1 | | -- |
| | | | | 125° F. | 4.9 | 5.8 | 6.1 | 6.5 | 6.9 | 7.3 | - | -- |
| 7 | Control - No additives (Composition D) | | 6.6 | room temperature | 6.4 | 6.9 | 6.8 | 6.7 | 6.8 | 6.9 | -- | -- |
| | | | | 125° F. | 6.4 | 6.8 | 6.6 | 6.7 | 6.8 | 6.9 | -- | -- |
| 8 | Control - No additives (Composition D) | -- | 6.6 | room temperature | 6.6 | 7.2 | 7.0 | 7.1 | 7.0 | 7.0 | -- | |
| | | | | 125° F. | 6.7 | 7.2 | 6.9 | 7.0 | 7.0 | 7.0 | -- | |
| 9 | 6% Urea with 4% Ethanol (Composition C without any additives) | - | 6.6 | room temperature | 6.3 | 6.9 | 6.8 | 6.9 | 6.9 | 7.1 | -- | |
| | | | | 125° F. | 7.2 | 7.9 | 7.9 | 8.0 | 8.0 | 8.2 | | |
| 10 | 1.38 Dimethyl Maleate | 144.12 | 6.7 | room temperature | 6.4 | 6.4 | 6.4 | 6.4 | 6.3 | 6.1 | 6.4 | - |
| | | | | 125° F. | 6.5 | 6.4 | 6.5 | 6.5 | 6.6 | 6.6 | 7.1 | -- |
| 11 | 1.54 Diethyl Malonate | 160 | 6.7 | room temperature | 6.4 | 6.5 | 6.5 | 6.5 | 6.5 | 6.4 | 6.7 | -- |
| | | | | 125° F. | 6.7 | 6.8 | 6.7 | 6.8 | 6.7 | 6.5 | 6.9 | - |
| 12 | 1.27 Dimethyl Malonate | 132.12 | 6.6 | room temperature | 6.1 | 6.1 | 6.2 | 6.1 | 6.0 | 5.8 | 6.1 | - |
| | | | | 125° F. | 6.1 | 6.2 | 6.2 | 6.3 | 6.3 | 6.2 | 6.7 | - |
| 13 | 0.86 Methyl Glycolate | 90.08 | 6.7 | room temperature | 5.9 | 6.0 | 5.9 | 5.9 | 5.8 | 5.6 | 5.9 | - |
| | | | | 125° F. | 6.2 | 6.6 | 6.5 | 6.7 | 7.1 | 7.2 | 7.9 | - |
| 14 | 1.46 ***Methyl Salicylate | 152 | 6.7 | room temperature | 6.8 | 6.7 | 6.8 | 6.9 | 7.0 | | -- | - |
| | | | | 125° F. | 7.6 | 7.8 | 7.8 | 7.8 | 7.8 | - | -- | -- |
| 15 | 1.40 Dimethyl Succinate | 146 | 6.7 | room temperature | 6.6 | 6.7 | 6.7 | 6.9 | 6.8 | 6.6 | 7.0 | |
| | | | | 125° F. | 7.2 | 7.1 | 7.2 | 7.3 | 7.2 | 7.0 | 7.4 | |
| 16 | Control - No additives (Composition D) | -- | 6.7 | room temperature | 6.3 | 6.2 | 6.3 | 6.3 | 6.6 | 6.6 | 6.6 | -- |
| | | | | 125° F. | 6.5 | 6.4 | 6.5 | 6.5 | 6.7 | 6.8 | 6.9 | -- |
| 17 | 1.34 Glycine Ethyl Ester (Hydrochloride) | 139.4 | 6.7 | room temperature | 6.2 | 6.2 | 5.8 | 5.9 | 5.8 | 5.8 | -- | -- |
| | | | | 125° F. | 5.9 | 6.3 | 6.5 | 6.8 | 7.2 | 7.2 | - | -- |
| 18 | 1.45 Glycine Propyl Ester | 151.4 | 6.8 | room temperature | 6.4 | 6.5 | 6.0 | 6.2 | 6.1 | 6.1 | - | - |
| | | | | 125° F. | 6.1 | 6.6 | 6.7 | 7.0 | 7.0 | 7.3 | | |
| 19 | Control - No Additives (Composition D) | -- | 6.6 | room temperature | 6.7 | 6.8 | 6.6 | 6.7 | 6.7 | 6.7 | - | |
| | | | | 125° F. | 6.8 | 6.9 | 6.7 | 6.8 | 6.9 | 6.9 | - | |

*Cloudy at Room Temperature
**Cloudy at Room Temperature
***Cloudy at Room Temperature Liquid detergent composition A was further subjected to storage stability tests at the intermediate temperature of 105° F. and also at room temperature, and the results obtained in such studies are reflected in Table 5 below.

TABLE 5

STORAGE STABILITY OF DETERGENT COMPOSITIONS A AND B WITH VARYING QUANTITIES OF METHYL OR ETHYL LACTATE

| Batch No. | Additional Ingredient wt. % w/w | Initial | 1 wk. | 4 wks. | 8 wks. | 11 wks. |
|---|---|---|---|---|---|---|
| | | pH Following Storage at 105° F. | | | | |
| 1 | 0.25% Methyl Lactate (Racemic) | 6.5 | 6.6 | 6.6 | 6.7 | 6.6 |
| 2 | 0.5% Methyl Lactate (Racemic) | 6.5 | 6.4 | 6.3 | 6.7 | 6.3 |
| 3 | 1.0% Methyl Lactate (Racemic) | 6.5 | 6.3 | 6.3 | 6.4 | 6.0 |
| 4 | 0.25% Methyl Lactate (Levorotatory) | 6.6 | 6.6 | 6.5 | 6.7 | 6.6 |
| 5 | 0.5% Methyl Lactate (Levorotatory) | 6.5 | 6.5 | 6.3 | 6.5 | 6.3 |
| 6 | 1.0% Methyl Lactate (Levorotatory) | 6.5 | 6.5 | 6.2 | 6.2 | 6.1 |
| 7 | 0.5% Ethyl Lactate (Racemic) | 6.5 | 6.8 | 6.7 | 6.7 | 6.7 |
| 8 | 1.0% Ethyl Lactate (Racemic) | 6.5 | 6.8 | 6.7 | 6.6 | 6.3 |
| 9 | 1.5% Ethyl Lactate (Racemic) | 6.5 | 6.4 | 6.3 | 6.4 | 6.2 |
| 10 | 6% No Additive (Control Batch) | 6.6 | 6.7 | 6.9 | 7.1 | 7.1 |
| 11 | Composition B - Control Batch (8% Ammonium xylene sulfonate in place of 6% urea with 2% ethanol) | 6.6 | 7.0 | 7.1 | 7.2 | 7.2 |
| | | pH Following Storage at Room Temperature | | | | |
| 12 | 0.25% Methyl Lactate (Racemic) | 6.5 | 6.6 | 6.6 | 6.4 | 6.3 |
| 13 | 0.5% Methyl Lactate (Racemic) | 6.5 | 6.5 | 6.3 | 6.1 | 6.0 |
| 14 | 1.0% Methyl Lactate (Racemic) | 6.5 | 6.5 | 6.3 | 6.0 | 5.8 |
| 15 | 0.25% Methyl Lactate (Levorotatory) | 6.6 | 6.6 | 6.4 | 6.5 | 6.2 |
| 16 | 0.5% Methyl Lactate (Levorotatory) | 6.5 | 6.4 | 6.5 | 6.2 | 5.9 |
| 17 | 1.0% Methyl Lactate (Levorotatory) | 6.5 | 6.3 | 6.5 | 5.9 | 5.7 |
| 18 | 0.5% Ethyl Lactate (Racemic) | 6.5 | 6.6 | 6.5 | 6.3 | 6.3 |
| 19 | 1.0% Ethyl Lactate (Racemic) | 6.5 | 6.5 | 6.5 | 6.1 | 6.1 |
| 20 | 1.5% Ethyl Lactate (Racemic) | 6.5 | 6.4 | 6.3 | 6.1 | 5.9 |
| 21 | 6% No Additive (Control Batch) | 6.6 | 6.6 | 6.6 | 6.7 | 6.6 |
| 22 | Composition B - Control Batch (8% Ammonium xylene sulfonate in place of 6% urea with 2% ethanol) | 6.6 | 7.0 | 7.0 | 7.1 | 6.8 |

Table 5 reflects the fact that an optically active hydrolyzable ester such as methyl lactate (levorotatory) is no more effective than a racemic mixture of methyl lactate. Table 5 also reflects optimal use levels on a weight basis of the two preferred esters of the composition, namely, methyl and ethyl lactate. The optimal use levels in question are further discussed below.

Table 5 also reflects the fact that an elevated storage temperature at a level intermediate between room temperature and 125° F. also leads, as expected, to an accelerated increase in pH levels, although to a smaller extent than that encountered at 125° F.

The pH values shown in Table 5 were all measured at room temperature.

Additionally, it should be noted that in the respective Tables although ammonium salts of surfactants were employed, alkali metal salts as well as mixtures of alkali metal salts and ammonium salts of the surfactants may also be employed with comparable results. Further, it will also be appreciated that other surfactants (anionic or not) in which the length of the alkyl chains and/or the number of ethylene oxide units are different are equally employable.

In light of the above findings, it is evident that certain hydrolyzable esters may be employed as effective stabilizing agents for controlling objectionable pH increases in aqueous systems which contain urea or other base liberating components.

Insofar as the use levels of the preferred esters of the present invention, i.e., methyl and ethyl lactates are concerned, it will be seen from the above data that such use level of the ester is dependent upon the precise ester involved (e.g. methyl or ethyl lactate), the amount of urea with ethanol employed as a hydrotrope and to a lesser extent, the storage conditions to which the resulting aqueous composition is or will be subjected.

The foregoing lactate esters, including in particular ethyl lactate are especially desirable and preferred because of their non-toxic nature as such as well as the non-toxic nature of the products of their hydrolysis. In the use of methyl lactate the amount of the toxic methyl alcohol product of the hydrolysis of such ester would ordinarily be de minimis in view of the low concentrations of such ester which are found to be effective in any event.

The above data appear to suggest that a minimum of about one part of the ester (e.g. methyl or ethyl lactate) for every 25 parts of urea appears to be necessary for pH maintenance in the 6 to 7 range. The more preferred level is about 1 part of the ester per 10 parts of urea and most preferred is about 1 part of ester to 6 parts of urea. The ratios for the other esters depend upon their molecular weights, in that the higher the molecular weight, the more ester is required per part of urea, the objective being to generate enough carboxylic or other acid from the hydrolysis of the ester employed to neutralize the ammonia liberated by the hydrolysis of urea.

The above data indicate that esters of amino acids such as glycine, glutamic and aspartic acid are also operable within the scope of the present invention. The preferred esters are those which will hydrolyze to $C_1$ to $C_4$ alkanols. Esters of molonic acid, glycolic acid and maleic acid were also found to be useful and are therefore within the scope of the present invention.

Accordingly, in the practice of the present invention, it will be seen that the $pK_a$ (as measured at room temperature or about 25° C.) of the precursor acid forming a hydrolyzable ester which is suitable for use in the practice of the invention lies in the range of about 2 to about 4. A non-limiting list of acid precursors of operable hydrolyzable esters is as follows:

| Acid | $pK_a$ |
|---|---|
| Lactic | 3.86 |
| Glycolic | 3.82 |
| Malonic | 2.85 |
| Aspartic | 2.09 ($pK_{a1}$) |
| Glutamic | 2.19 ($pK_{a1}$) |
| Glycine | 2.34 |
| Maleic | 2.00 ($pK_{a1}$) |
| Fumaric | 3.03 ($pK_{a1}$) |

When urea is used as a hydrotrope with other cohydrotropes, the ratio to be used will depend upon the other ingredients of the detergent composition and cost considerations. The exact ratio to be used for a particular formulation may be determined with routine experimentation by a person of ordinary skill in the art.

As general theoretical considerations underlying the foregoing conclusions, it may be observed that the key factors for the selection of operable hydrolyzable esters, at least in the aliphatic series, can be correlated with the acid dissociation constant $pK_a$ of the acid from which the ester is derived. The size of the alkyl group involved in the ester in question is also important in this regard. Both of these parameters determine the rate at which the ester reacts directly with nucleophiles such as ammonia by way of ammonolysis or indirectly by hydrolysis first to the free acid (and alcohol) followed by acid/-base neutralization.

In the case of a dicarboxylic acid such as aspartic acid where both $pK_a$ values ($pK_{a1}=2.09$ and $pK_{a2}=3.86$) are within the range of about 2 to about 4, the corresponding ester is effective till it is fully hydrolized. In the case of, e.g., glutamic acid where one of the $pK_a$ values falls outside of such range ($pK_{a1}=2.19$ and $pK_{a2}=4.25$) such ester is effective till complete hydrolysis of the carboxylic group with the acceptable $pK_a$ value. Since there is no reason for the alkanoic portions of such multiple acid group esters to be identical such esters will hydrolyze to yield more than one alkanol. Quite apart from such "mixed" esters, there is of course no reason why a mixture of more than one acceptable ester may not be gainfully employed.

On the other hand, the $pK_a$ values of succinic acid ($pK_{a1}=4.19$; $pK_{a2}=5.57$) and of acetic acid ($pK_1$ 4.76) fall outside the above range. Accordingly, the esters of such acids (the dimethyl ester of succinic acid and the methyl ester of acetic acid) do not hydrolyze fast enough to maintain the pH of the liquid detergent composition below 7.0 as seen from the above data.

Likewise, the methyl ester of salicylic acid ($pK_a=2.97$), unexpectedly, was not effective. In the case of methyl salicylate, the ortho position of the phenolic hydroxyl group is believed to allow for complex formation with the ester group via hydrogen bonding. Such complex formation appears to make the ester group less reactive to either hydrolysis or ammonolysis compared to esters of non-complexing acids having similar $pK_a$ values. Thus, although methyl salicylate was not found to be an operable hydrolyzable ester within the practice of the present invention, it does not necessarily follow from one such single explainable exception that all esters of aromatic acids would be unavailable for use in the practice of this invention. In fact, it may be generalized that the alkyl esters of any acid, whether aromatic or otherwise, whose $pK_a$ value lies within the range of about 2 to about 4 may be used in the practice of the present invention.

The scope of this invention is further defined and is to be read in conjunction with the appended claims.

What is claimed is:

1. An aqueous composition of improved pH storage stability comprising urea which further comprises an effective amount of a hydrolyzable ester of a Lowry-Bronsted acid which has at least one acidity constant $pK_a$ in the range of about 2 to about 4 sufficient to neutralized any ammonia liberated by decomposition of urea.

2. An aqueous composition according to claim 1 wherein the hydrotrope comprises urea in combination with an alkanol.

3. An aqueous composition according to claim 2 wherein the alkanol is ethanol.

4. An aqueous composition according to claim 3 which comprises 6% w/w urea and about 2 to about 4% w/w ethanol.

5. An aqueous composition according to claim 1 which comprises about 1 part by weight of said hydrolyzable ester for about 6 to about 25 parts by weight of urea in relation to each other.

6. An aqueous composition according to claim 5 which comprises about 6 to about 10 parts by weight of urea.

7. An aqueous composition according to claim 5 which comprises about 6 parts by weight of urea.

8. An aqueous composition according to claim 1 wherein said hydrolyzable esters are selected from the group consisting of those esters which hydrolyze to form (a) alkanols selected from the group consisting of methanol, ethanol, 1-propanol, 2-propanol and mixtures thereof and to form (b) Lowry-Bronsted acids selected from the group consisting of lactic acid, glycolic acid, malonic acid, maleic acid, fumaric acid, aspartic acid, glutamic acid and glycine and (c) mixtures of such esters.

9. An aqueous composition according to claim 8 wherein said hydrolyzable ester is selected from the group consisting of methyl lactate, ethyl lactate and mixtures thereof.

10. An aqueous composition according to claim 1 which further comprises about 1% w/w to about 91% w/w of a surface active agent selected from the group consisting of soaps, other anionic surfactants, non-ionic, cationic, zwitterionic and ampholytic surfactants and mixtures thereof.

11. An aqueous composition according to claim 10 wherein said surfactant is an alkali metal or ammonium linear alkyl benzene sulfonate.

12. An aqueous composition according to claim 11 which further comprises an alkali metal or ammonium salt of a sulfated ethoxylated alcohol surfactant.

13. An aqueous composition according to claim 12 which comprises about 6% w/w urea, about 4% w/w ethanol, about 30% w/w ammonium linear alkyl benzene sulfonate, about 5% w/w of a sulfated ethoxylated $C_{10}$-$C_{15}$ alcohol and about 1% w/w of esters selected from the group consisting of those esters which hydrolyze to form (a) alkanols selected from the group consisting of methanol, ethanol, 1-propanol, 2-propanol and mixtures thereof and to form (b) Lowry-Bronsted acids selected from the group consisting of lactic acid, glycolic acid, molonic acid, maleic acid, fumaric acid, aspartic acid glutamic acid and glycine and (c) mixtures of such esters.

14. An aqueous composition according to claim 12 which further comprises lauric diethanolamide.

15. An aqueous composition according to claim 14 which comprises about 6% w/w urea, about 2% w/w ethanol, about 24% w/w ammonium linear alkyl sulfonate, about 5% w/w of a sulfated ethoxylated $C_{10}$-$C_{15}$ alcohol, about 3% w/w lauric diethanolamide and about 1% w/w of esters selected from the group consisting of those esters which hydrolyze to form (a) alkanols selected from the group consisting of methanol, ethanol, 1-propanol, 2-propanol and mixtures thereof and to form (b) Lowry-Bronsted acids selected from the group consisting of lactic acid, glycolic acid, malonic acid, maleic acid, fumaric acid, aspartic acid, glutamic acid and glycine and (c) mixtures of such esters.

* * * * *